US009947993B2

(12) United States Patent
Toivanen

(10) Patent No.: US 9,947,993 B2
(45) Date of Patent: Apr. 17, 2018

(54) ANTENNA STACK

(71) Applicant: Microsoft Technology Licensing, LLC, Redmond, WA (US)

(72) Inventor: Jalmari Toivanen, Espoo (FI)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 15/235,348

(22) Filed: Aug. 12, 2016

(65) Prior Publication Data

US 2018/0048049 A1 Feb. 15, 2018

(51) Int. Cl.

| | |
|---|---|
| ***H01Q 3/24*** | (2006.01) |
| ***H01Q 1/24*** | (2006.01) |
| ***H01Q 1/48*** | (2006.01) |
| ***H01Q 1/22*** | (2006.01) |
| ***H01Q 1/50*** | (2006.01) |

(52) U.S. Cl.
CPC ..... *H01Q 1/243* (2013.01); *H01Q 1/2291* (2013.01); *H01Q 1/48* (2013.01); *H01Q 1/50* (2013.01)

(58) Field of Classification Search
None
See application file for complete search history.

(56) References Cited

U.S. PATENT DOCUMENTS

| | | | | |
|---|---|---|---|---|
| 6,757,267 | B1 | 6/2004 | Evans et al. | |
| 6,801,790 | B2 | 10/2004 | Rudrapatna | |
| 8,798,554 | B2 | 8/2014 | Darnell et al. | |
| 8,860,619 | B2 | 10/2014 | Nysen | |
| 9,100,096 | B2 | 8/2015 | Montgomery et al. | |
| 9,130,279 | B1 | 9/2015 | Lee et al. | |
| 9,137,349 | B2 | 9/2015 | Huang et al. | |
| 2006/0276132 | A1 | 12/2006 | Sheng-Fuh et al. | |
| 2008/0174508 | A1 | 7/2008 | Iwai et al. | |
| 2011/0032171 | A1* | 2/2011 | Tuttle | H01Q 1/2216 343/876 |
| 2012/0046003 | A1* | 2/2012 | Ying | H04B 1/406 455/90.2 |

(Continued)

FOREIGN PATENT DOCUMENTS

| | | | |
|---|---|---|---|
| EP | 2117075 | A1 | 11/2009 |
| WO | 2013014458 | A1 | 1/2013 |

OTHER PUBLICATIONS

"Antenna designs for MIMO systems", Retrieved on: Jan. 4, 2016, 120 pages, Available at: http://physics.oregonstate.edu/~hetheriw/astro/rt/info/rf_antennas/antenna_designs_mimo.pdf.

(Continued)

*Primary Examiner* — Trinh Dinh

(57) ABSTRACT

An antenna stack and device is described. In an embodiment, a device comprises: a first antenna element coupled to a first antenna feed, the first antenna feed being coupled to a first feed line via a first impedance matching circuit; a second antenna element coupled to a second antenna feed, the second antenna feed being coupled to a second feed line via a second impedance matching circuit; and a radio frequency (RF) switch configurable into states; wherein in a first state, the switch is configured to ground the first antenna feed; in a second state, the switch is configured to be in a non-connection state, wherein neither the first antenna feed nor the second antenna feed is grounded; and in a third state, the switch is configured to ground the second antenna feed.

20 Claims, 5 Drawing Sheets

(56) References Cited

U.S. PATENT DOCUMENTS

2012/0162025 A1* 6/2012 Ohno ..... H01Q 3/00 343/702
2012/0242558 A1 9/2012 Song et al.
2013/0241797 A1* 9/2013 Kuo ..... H01Q 1/243 343/876
2013/0241798 A1* 9/2013 Lee ..... H01Q 1/50 343/876
2013/0307740 A1 11/2013 Pajona et al.
2014/0015729 A1* 1/2014 Uejima ..... H01Q 9/14 343/850
2014/0132465 A1* 5/2014 Sanchez ..... H01Q 1/243 343/748
2014/0253398 A1* 9/2014 Hsieh ..... H01Q 5/328 343/745
2014/0266968 A1* 9/2014 Wong ..... H01Q 5/35 343/876
2014/0354508 A1* 12/2014 Lee ..... H01Q 1/48 343/860
2015/0036656 A1 2/2015 McCarthy et al.
2016/0276742 A1* 9/2016 Yu ..... H01Q 1/48
2017/0149139 A1* 5/2017 Wong ..... H01Q 9/0421

OTHER PUBLICATIONS

Salas, Phil, "Auto-tuner Feedline Management and Station Protection Accessory", Published on: Sep. 27, 2015, 6 pages, Available at: http://www.ad5x.com/images/Articles/Autotuner%20Antenna %20Management%20RevA.pdf.

Zhao, et al., "SAR Study of Different MIMO Antenna Designs for LTE Application in Smart Mobile Handsets", In Proceedings of IEEE Transactions on Antennas and Propagation, vol. 61, No. 6, Jun. 2013, pp. 3270-3279.

"International Search Report and Written Opinion Issued in PCT Application No. PCT/US2017/045819", dated Oct. 27, 2017, 15 pages.

* cited by examiner

ANTENNA STACK

BACKGROUND

Different types of mobile communication devices may have multiple radios, for example, cellular, Wireless Local Area Network (WLAN), Bluetooth, Near Field Communication (NFC), and hence multiple antennas. Further a single radio may use multiple antennas for antenna diversity and/or Multiple Input Multiple Output (MIMO) operation. This may offer increased capacity and enhanced performance for communication systems, possibly even without the need for increased transmission power. Limited space in a device, however, may need to be considered in designing such devices and compact antennas may be needed to fit the form factors of portable devices. Such antennas may be located in close proximity to each other due the small form factor of such devices.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter.

An antenna stack and device is described. In an embodiment, a device comprises: a first antenna element coupled to a first antenna feed, the first antenna feed being coupled to a first feed line via a first impedance matching circuit; a second antenna element coupled to a second antenna feed, the second antenna feed being coupled to a second feed line via a second impedance matching circuit; and a radio frequency (RF) switch configurable into states; wherein in a first state, the switch is configured to ground the first antenna feed; in a second state, the switch is configured to be in a non-connection state, wherein neither the first antenna feed nor the second antenna feed is grounded; and in a third state, the switch is configured to ground the second antenna feed.

In other embodiments, a device and a method for grounding antenna of an antenna stack by a RF switch are discussed.

Many of the attendant features will be more readily appreciated as they become better understood by reference to the following detailed description considered in connection with the accompanying drawings.

DESCRIPTION OF THE DRAWINGS

The present description will be better understood from the following detailed description read in light of the accompanying drawings, wherein.

Like references are used to designate like parts in the accompanying drawings.

DETAILED DESCRIPTION

The detailed description provided below in connection with the appended drawings is intended as a description of the embodiments and is not intended to represent the only forms in which the embodiment may be constructed or utilized. However, the same or equivalent functions and structures may be accomplished by different embodiments.

Although the embodiments may be described and illustrated herein as being implemented in a smartphone, this is only an example implementation and not a limitation. As those skilled in the art will appreciate, the present embodiments are suitable for application in a variety of different types of devices comprising wireless communication capabilities having antenna stack, for example mobile phones (including smartphones), tablet computers, phablets, laptops, table-laptop hybrids, potable game consoles, portable media players, etc.

Antennas operating close to each other simultaneously may lead to mutual coupling, Specific Absorption Rate (SAR) hotspots or both. Mutual coupling may deteriorate performance, while SAR hotspots may have health effects on a user of the device. Further, regulatory authorities may need compliance to SAR limits by a device before allowing sale of the device. According to an embodiment a radio frequency (RF) switch may be configured in an assembly of two or more co-located antenna elements, the pole of the RF switch being connected to an electrical ground. In one state the switch grounds a first feed. In another state the switch grounds a second feed. In yet another state, the switch does not ground any of the feeds. According to an embodiment, coupling between the antennas may be reduced by grounding the antenna feed which is not needed. According to an embodiment, SAR hotspots may be avoided by grounding an antenna which is not needed, by using an RF switch to ground its corresponding antenna feed. An antenna feed may also be grounded, for example when the device is in proximity of a user's body, thus preventing the user from too much exposure to radio and microwaves emanating from the device. According to an embodiment, the antenna arrangement described above may comprise shorting elements, which may be connectable to an electrical ground by an RF switch, allowing use of the antenna element for multiple frequencies. According to an embodiment, the first antenna element may be coupled with two antenna feeds: one configured for Long Term Evolution (LTE) Low Band (LB) and other configured for LTE High Band (HB) and Medium (MB) Band. According to an embodiment, the second antenna feed may be configured for WLAN frequencies. According to an embodiment, a device may comprise more than one of an antenna arrangement described above, allowing MIMO operation, with lower mutual coupling and lesser or no SAR hotspots. According to an embodiment, the communication capabilities of a device may be improved by using antenna assemblies as described herein.

Figure 1:
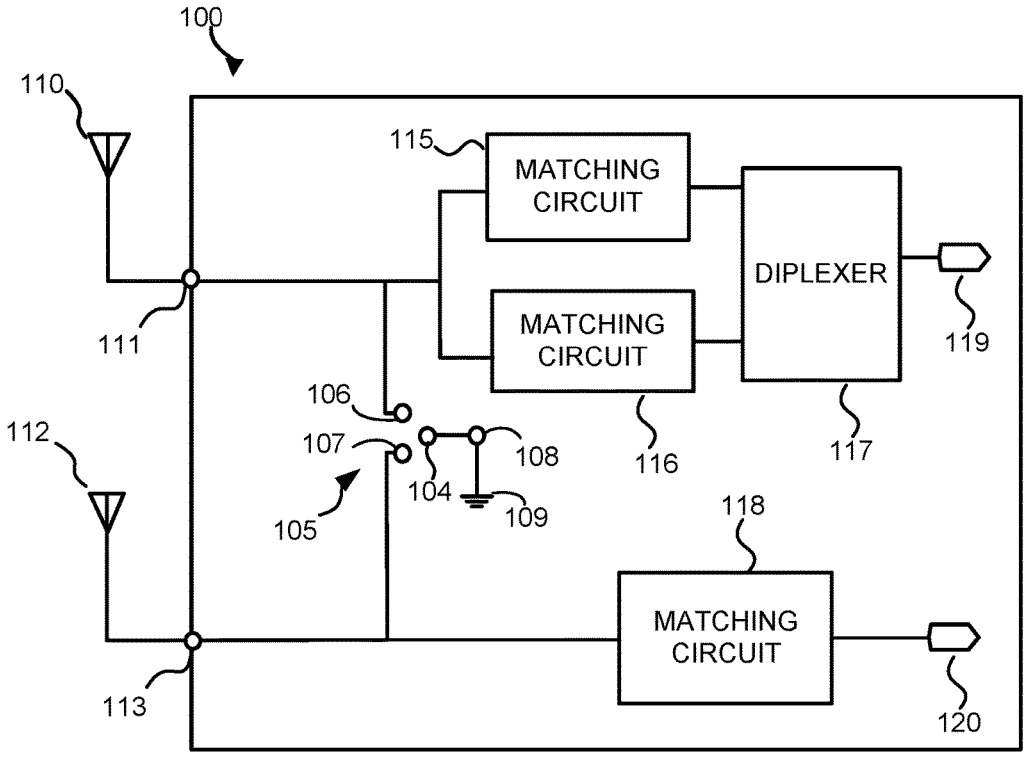
FIG. 1 illustrates a schematic representation of a device comprising multiple antenna elements, according to an embodiment.

FIG. 1 illustrates a schematic representation of a device 100, according to an embodiment, as a circuit diagram. Device 100 comprises two antenna elements 110 and 112, two antenna feeds 111 and 113, impedance matching circuits 115, 116, 118, a diplexer 117, and feed lines 119, 120 coupled to corresponding radios (not shown in FIG. 1) and an RF switch 105. A radio may, for example, comprise one or more of: a receiver, a transmitter, a transceiver, an RF front end, any intermediate circuitry etc. Although antenna elements 110, 111 are illustrated as outside the device 100, they may be inside the device 100 or they may be implemented by using a housing of the device 100 or a portion thereof.

Referring to FIG. 1, antenna element 110 is coupled to antenna feed 111. Antenna feed 111 is coupled with impedance matching circuits 115, 116, which are configured in parallel to each other and coupled to a diplexer 117. The diplexer 117 is connected to a feed line 119 which is coupled to a radio (not shown in FIG. 1). Antenna feed 111 is also coupled to RF switch 105. Antenna element 112 is coupled to antenna feed 113. Antenna feed 113 is coupled to impedance matching circuit 118, which is connected via a feed line 120 to a radio (not shown in FIG. 1). Antenna feed 112 is also coupled to RF switch 105. RF switch 105 may be a single pole multi-throw, solid state switch, the pole 108 being connected to an electrical ground plane in the device 100. According to an embodiment, RF switch 105 may comprise a Silicon on Insulator (SoI) switch, a Gallium Arsenide (GaAs) switch, Complementary Metal on Semiconductor (CMOS) switch, a Micro-electro-mechanical system (MEMS) switch, a PiN diode switch, or a combination thereof.

According to an embodiment, a radio coupled to feed line 119 may be a transmitter. Signals coming via feedline 119 may be frequency de-multiplexed into two different frequency range signals by diplexer 117 and fed to corresponding impedance matching circuit 115, 116. Impedance matching circuit 115, 116 may match the impedance of feed line 119 to the impedance of antenna 110 for maximum transfer of signal energy to antenna 110 and/or to prevent standing waves. The signal so transferred via the impedance matching circuits 115, 116 may reach the antenna and be transmitted. According to an embodiment, a radio coupled to feedline 119 may be a receiver, where the signals travel in a direction opposite to the transmitter case. According to an embodiment, the radio coupled to feedline 119 may be a transceiver, supporting both transmission and reception of radio signals. Feed line 120 may be coupled to a receiver, transmitter or a transceiver. For ease of description the case of a receiver is discussed here. Signals are received by antenna element 112 and transferred via the antenna feed 113 and impedance matching circuit 118 to feed line 120. The impedance matching circuit 118 may match the impedance of antenna element 112 to the impedance of feed line 120. RF Switch 105 may comprise a pole 108 connected to a ground plane 109. RF switch 105 may have three states: 106, 107 and 104. In state 104, RF switch 105 may be in an open state. In state 106, the RF switch 105 may connect antenna feed 111 to electrical ground 109. In state 107, the RF switch 105 may connect antenna feed 113 to electrical ground plane 105. Furthermore, the number of the states may vary depending on the number of used radios within the device 100, or depending on the number of different antennas within the device 100. Three states has been illustrated only as an illustrative embodiment, however the number of states, and configuration of the states may vary from two states to various states.

According to an embodiment, grounding antenna feed 111, by configuring RF switch 105 in state 106 improves performance of antenna element 112 and consequently the corresponding radio coupled to it via antenna feed 113, impedance matching circuit 118 and feedline 120. According to an embodiment, grounding feed 113, by configuring RF switch 105 in state 107, improves performance of antenna element 110 and consequently the radios connected to it. According to an embodiment, grounding an antenna feed 111 or 113, reduces or eliminates SAR hotspots potentially caused by antenna elements 110, 112. According to an embodiment, the state of RF switch 105 may be configured based on operating characteristics of the radios, which are coupled to antenna elements 110, 112. The state of RF switch 105 may also be configured based on operating characteristics of the device, usage characteristics of the device, conditions of the wireless networks to which the device is configured to connect, user input or a combination thereof. For example, if a network corresponding to an antenna element 110, 112 is unavailable, the corresponding feed 111, 113 may be grounded. According to an embodiment, in some situations, for example when the device is away from a user's body, the RF switch 105 may be put in state 104, so that both antenna elements 110 and 114 may operate simultaneously. According to an embodiment, device 100 may comprise a controller (not shown in FIG. 1), configured to control the operation of RF switch 105.

Referring to FIG. 1, according to an embodiment, feed line 119 may carry signals with frequencies corresponding to Long Term Evolution Low Band (LTE-LB) and Long Term Evolution Medium and High Band (LTE-MHB). Diplexer 117 may frequency multiplex/de-multiplex these frequencies. Impedance matching circuit 115 may correspond to LTE-LB frequencies and impedance matching circuit 116 may correspond to LTE-MHB frequencies. Antenna element 110 and antenna feed 111 may also be configured to operate at frequencies corresponding to LTE-LB and LTE-MHB. According to an embodiment, feed line 120 may carry signals with frequencies corresponding to Wireless Local Area Network WLAN, for example as specified in IEEE standards family 802.11. In this embodiment, impedance matching circuit 118, antenna feed 113 and antenna 112 may be configured to operate at frequencies corresponding to WLAN. According to an embodiment either of the impedance matching circuits 115, 116 and diplexer 117 may be removed. According to an embodiment, RF switch 105 may be configured to be coupled to antenna feeds 111, 113 after impedance matching circuits 115, 116, 118. According to an embodiment, this may improve grounding and isolation by causing a substantial impedance mismatch when the RF switch 105 is configured into a state 106,107 which grounds an antenna feed 111,113. This may minimize radiation or reception by the corresponding antenna element 110, 112, enabling improvement in isolation. For example if the RF switch is configured in state 106, there a high impedance mismatch may between the antenna element 110, antenna feed 111 and the feed line 119, causing minimum or no power transfer to or from the antenna element 110, thus reducing coupling with antenna element 112. Similarly, when RF switch 105 is configured in state 107, antenna element 110 may experience no or minimal coupling with antenna element 112.

Figure 2:
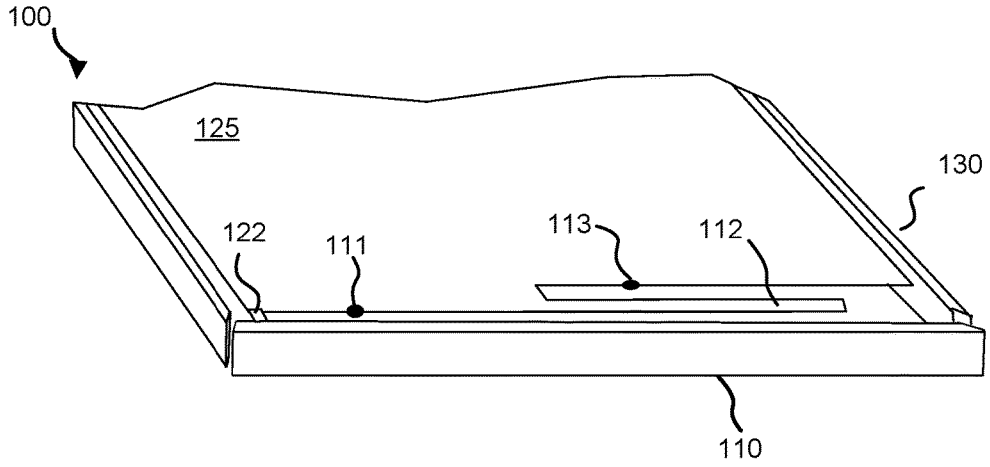
FIG. 2 illustrates a schematic representation of sectional view of a portion of a device according to an embodiment.

FIG. 2 illustrates a sectional view of a portion of a device 100, showing an implementation of an antenna assembly according to an embodiment. The antenna elements 110 and 111 and corresponding antenna feeds 111, 112 of embodiments of FIG. 1 may be implemented as illustrated in FIG. 2. Device 100 comprises a device housing 130, at least a portion of which is conductive. Device may comprise a Printed Circuit Board (PCB) 125. Many components like a processors, cameras, digital signal processors etc. (not shown in FIG. 2) may be configured on the PCB 125. An antenna element 112 is configured at an edge of the PCB 125. According to an embodiment, antenna element 112 may be a Planar Inverted F Antenna (PIFA). An antenna feed 113 is coupled to antenna element 112. According to an embodiment, antenna feed 113 may be coupled to antenna element 112 at a point between middle of the antenna element 112 and the end where it is connected to the PCB 125 to implement an inverted F antenna. Further, a conductive portion of device housing 130 serves as antenna element 110 to which feed 111 is coupled. An RF switch 105 (not shown in FIG. 2) may be configured on PCB 125. RF switch 105 may have three states corresponding to feed 111 grounded, feed 113 grounded and no feed grounded. The operation of the RF switch may be similar to that described in embodiments of FIG. 1. According to an embodiment, a shorting element 122 may short the antenna element 110, implementing an inverted F-antenna. According to an embodiment, antenna feed 111 may be coupled to antenna element 110 at a point between middle of the antenna element 112 and an end where shorting element 122 is configured to implement an inverted F antenna. According to an embodiment, a third feed (not shown in FIG. 2) may be coupled to antenna element 110 at an end opposite to the shorting element 122. According to an embodiment, a controller (not shown in FIG. 2) may be configured on PCB 125, configured to control the operation of RF switch 105 (not shown in FIG. 2).

Figure 3:
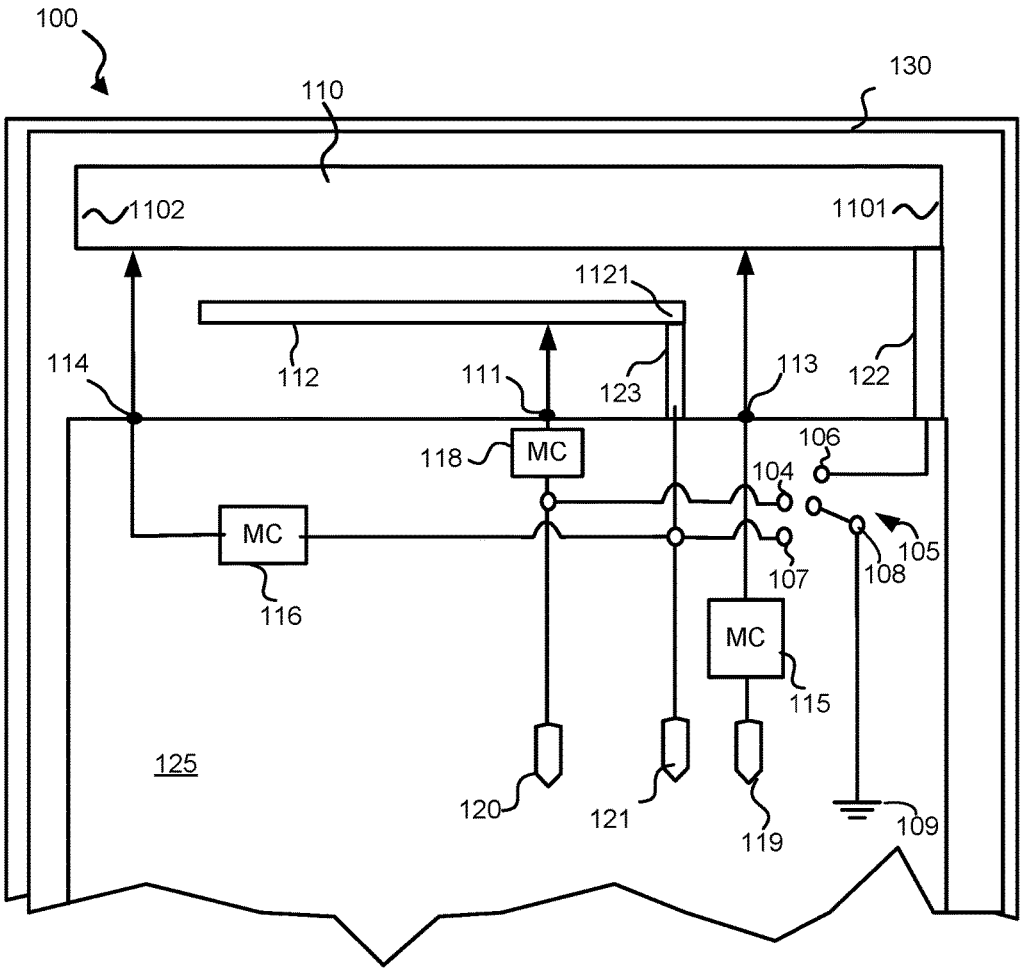
FIG. 3 illustrates a schematic representation of a circuit of a device comprising multiple antenna elements and grounding components, according to an embodiment.

FIG. 3 illustrates a sectional view of a device 100 according to an embodiment. Device 100 comprises a device housing 130, a PCB 125, antenna elements 110, 112, antenna feeds 111, 113,114, impedance matching circuits 115, 116, 118, feed lines 119, 120, 121, RF switch 105 and shorting elements 122, 123.

Referring to FIG. 3, in an embodiment, antenna elements 110, 112 may be part of the PCB 125, the shorting elements 122, 123 providing both structural support and a galvanic connection. Antenna feed 113 is coupled to antenna element 110 at a suitable distance from shorting element 122, the shorting element 122 being configured at an end 1101 of the antenna element 110. The distance between antenna feed 113 and shorting element 122 may depend on, for example, frequency of signals for which antenna feed 113 is configured, dimensions of antenna element 110, properties desired from the antenna so implemented, or a combination thereof. Antenna feed 114 is coupled to antenna element 110 at a point substantially near an end 1102 of the antenna element 110 which is opposite to the end 1101 where shorting element 122 is configured. Antenna element 112 may be configured in a gap between the antenna element 110 and main portion of PCB 125. Shorting element 123 is configured at an end 1121 of the antenna element 112. Antenna feed 111 is coupled to antenna element 112 at a suitable distance from shorting element 123. The distance between antenna feed 111 and shorting element 123 may depend on, for example, frequency of signals for which antenna feed 111 is configured, dimensions of antenna element 112, properties desired from the antenna so implemented, or a combination thereof. According to an embodiment, antenna feed 111 may be coupled to antenna element 112 at a point between middle of the antenna element 112 and an end where it is connected to the PCB 125 via shorting element 123 to implement an inverted F antenna. Antenna feed 113 is coupled to a feed line 119 via impedance matching circuit 115. Feed line 119 may be configured to carry signals to corresponding to two frequencies, one being higher than the other. Further antenna feed 111 is coupled to feed line 120 via impedance matching circuit 118. Antenna feed 114 is coupled to feed line 121 via impedance matching circuit 116. RF switch 105 may be a one pole multiple throw solid state switch. According to an embodiment, the RF switch 105 may have three states. The pole 108 may be connected to a device ground plane 109. Shorting element 122, impedance matching circuit 118 and hence antenna feed 111, shorting element 123, impedance matching circuit 116 and hence antenna feed 114 are connectable to device ground plane 109 via the RF switch 105. In state 106, shorting element 122 may be grounded, allowing antenna element 110 to transmit and/or receive higher frequency signals travelling via feed line 119. According to an embodiment, radios coupled to feed lines 120 and 121 may be turned off when RF switch 105 is in state 106. In state 104 of RF switch 105, impedance matching circuit 118 and hence the antenna feed 111 may be connected to device ground plane 109, allowing the antenna element 110 to transmit and/or receive signals corresponding to lower frequency signals travelling via feed line 119 and signals travelling via antenna element 121. In switch state 107, shorting element 123 and impedance matching circuit 116 and hence antenna feed 114 may be connected to device ground plane 109, allowing antenna element 112 to transmit and/or receive signals travelling via feed line 120 and antenna element 110 to transmit and/or receive lower frequency signals travelling via feed line 119.

Referring to FIG. 3, RF switch 105 may be configured into states 106, 104 and 107 based on multiple factors, including but not limited to: availability and signal power characteristics of wireless networks, user preference, proximity of device 100 to the user, etc. According to an embodiment, feedline 119 and impedance matching circuit 115 may be configured for frequencies corresponding to LTE-LB. According to an embodiment, feedline 119 and impedance matching circuit 115 may be configured for frequencies corresponding to frequencies selected from the range 1 Ghz to 5 Ghz. According to an embodiment, feedline 119 and impedance matching circuit 115 may be configured for frequencies near or equal to 2 Ghz. According to an embodiment, feedline 120 and impedance matching circuit 118 may be configured for frequencies corresponding to WLAN. According to an embodiment, feedline 121 and impedance matching circuit 116 may be configured for frequencies corresponding to LTE-MHB. According to an embodiment, MIMO antennas with lower mutual coupling may be implemented. According to an embodiment, SAR hotspots may be reduced. According to an embodiment, device 100 may comprise multiple antenna stacks each comprising multiple antenna elements and feeds, wherein an RF switch is configured as discussed herein. According to an embodiment, if an antenna element in one antenna stack is grounded, a corresponding antenna element in another antenna stack may be configured to become operational, allowing MIMO implementation, improvement in antenna isolation and reduction in SAR hot spots. According to an embodiment, a conductive portion of housing 130 may act as antenna element 110. According to an embodiment, a controller (not shown in FIG. 3) may be configured on PCB 125, configured to control the operation of RF switch 105. The number of the states of the RF switch 105 may depend on the number of radios of the device 100 and/or the number of antenna elements of the device 100. According to an embodiment, RF switch 105 may be configured before impedance matching circuit 116, 115, 118.

Figure 4:
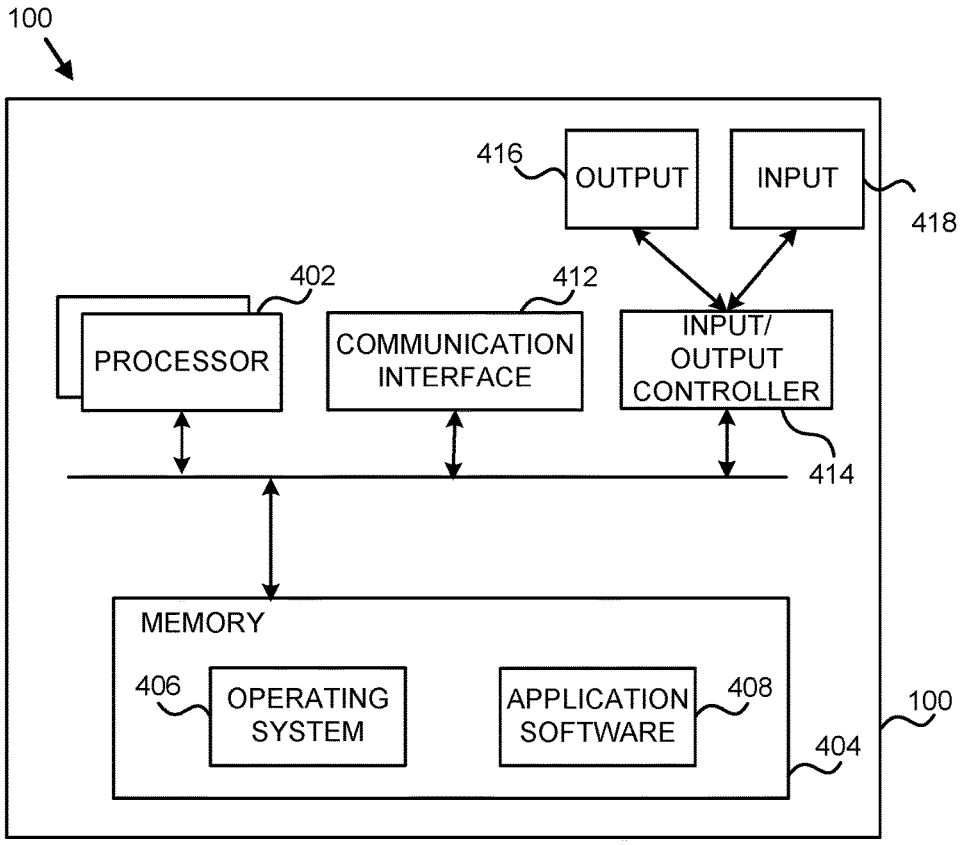
FIG. 4 illustrates a device according to an embodiment, as a computing device in a block diagram.

FIG. 4 illustrates an example of components of a computing device 100 which may be implemented as a form of a computing and/or electronic device. The computing device 100 comprises one or more processors 402 which may be microprocessors, controllers or any other suitable type of processors for processing computer executable instructions to control the operation of the apparatus 100. Platform software comprising an operating system 406 or any other suitable platform software may be provided on the apparatus to enable application software 408 to be executed on the device.

Computer executable instructions may be provided using any computer-readable media that are accessible by the device 100. Computer-readable media may include, for example, computer storage media such as a memory 404 and communications media. Computer storage media, such as a memory 404, include volatile and non-volatile, removable and non-removable media implemented in any method or technology for storage of information such as computer readable instructions, data structures, or program modules. Computer storage media include, but are not limited to, RAM, ROM, EPROM, EEPROM, flash memory or other memory technology, CD-ROM, digital versatile disks (DVD) or other optical storage, magnetic cassettes, magnetic tape, magnetic disk storage or other magnetic storage devices, or any other non-transmission medium that can be used to store information for access by a computing device Although the computer storage medium (the memory 404) is shown within the device 100, it will be appreciated, by a person skilled in the art, that the storage may be distributed or located remotely and accessed via a network or other communication link (e.g. using a communication interface 412).

The device 100 may comprise an input/output controller 414 arranged to output information to an output device 416 which may be separate from or integral to the device 100. The input/output controller 414 may also be arranged to receive and process an input from one or more input devices 418. In one embodiment, the output device 416 may also act as the input device. The input/output controller 414 may also output data to devices other than the output device, e.g. a locally connected printing device. According to an embodiment, the device 100 for example as described in embodiments of FIG. 1 to FIG. 3, may be established with the features of FIG. 2, for example the operating system 406 and the application software 408 working jointly, and executed by the processor 402, may control the states of RF switch 105. According to an embodiment, antenna elements 110, 112, antenna feeds 111,113, 114, RF switch 105, feedlines 120, 119, 121, impedance matching circuits 116, 118, 115 and associated radios described in embodiments of FIG. 1, FIG. 2, and FIG. 3 may comprise the communication interface 412 of FIG. 4. According to an embodiment, communication interface 412 may comprise a controller (not shown in FIG. 4), the controller being configured to control the operation of RF switch 105.

The functionality described herein can be performed, at least in part, by one or more hardware logic components. According to an embodiment, the computing device 100 is configured by the program code 406, 408 when executed by the processor 402 to execute the embodiments of the operations and functionality described. Alternatively, or in addition, the functionality described herein can be performed, at least in part, by one or more hardware logic components. For example, and without limitation, illustrative types of hardware logic components that can be used include Field-programmable Gate Arrays (FPGAs), Program-specific Integrated Circuits (ASICs), Program-specific Standard Products (ASSPs), System-on-a-chip systems (SOCs), Complex Programmable Logic Devices (CPLDs), Graphics Processing Units (GPUs).

Figure 5:
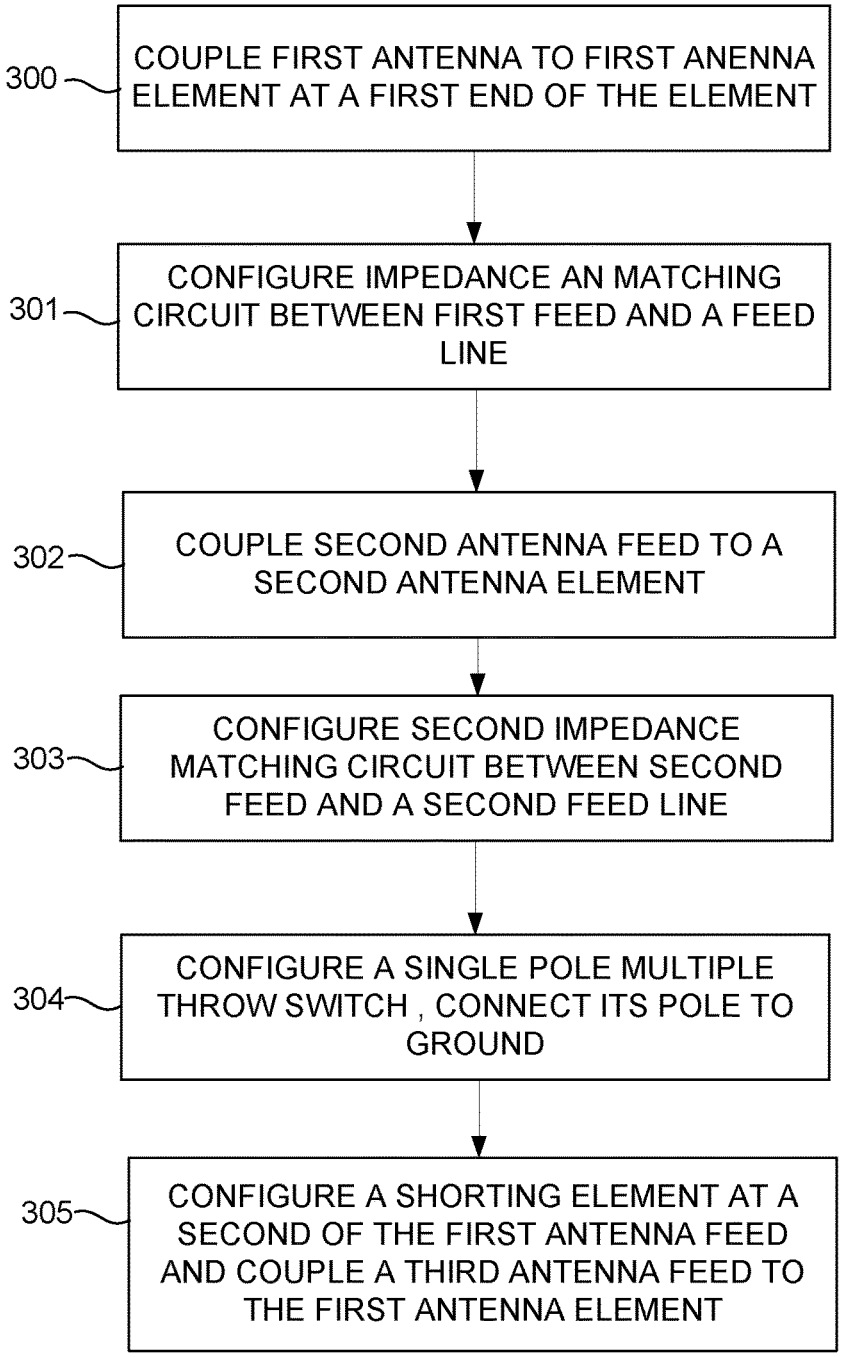
FIG. 5 illustrates a schematic flow chart of a method for grounding at least one antenna of an antenna stack in accordance with an embodiment.

FIG. 5 illustrates, as a schematic flow chart, a method in accordance with an embodiment. Referring to FIG. 5, according to an embodiment the process comprises operations 300, 301, 302, 303, and 304. The process may be carried out, for example, on an assembly line where a device 100 is assembled. According to an embodiment, at least one of the operations 300, 301, 302, 303, and 304 may be carried out manually. According to an embodiment, at least one of the operations 300, 301, 302, 303, and 304 may be carried out on an automated assembly line, for example by industrial robots.

Operation 300 may include coupling a first antenna feed 114 to a first antenna element 110. According to an embodiment, the coupling may be done at one 1102 of the two ends 1101, 1102 of the first antenna element 110.

Operation 301 may include configuring a first impedance matching circuit 116, between the first antenna feed and a feed line 119.

Operation 302 may include coupling a second antenna feed 111 to a second antenna element 112, the second antenna element 112 being implemented on a PCB 125, for example by etching or depositing metallic material on a substrate.

Operation 303 may include configuring a second impedance matching circuit 118 between antenna feed 113 and a feed line 120.

Operation 304 may include configuring a single pole multi-throw RF switch 105 on the PCB 125 and connecting its pole 108 to an electrical ground plane 109.

According to an embodiment, a method may further comprise Operation 305. Operation 305 may include configuring a shorting element 122 at an end 1101 of the antenna element 110 which is opposite to the end 1102 where the shorting element 122 is configured. Further operation 305 may include coupling a third antenna feed 113 to the first antenna element 110 at a point which is in between a central point of antenna element 110 and the end 1101 where shorting element 122 is configured.

Figure 6:
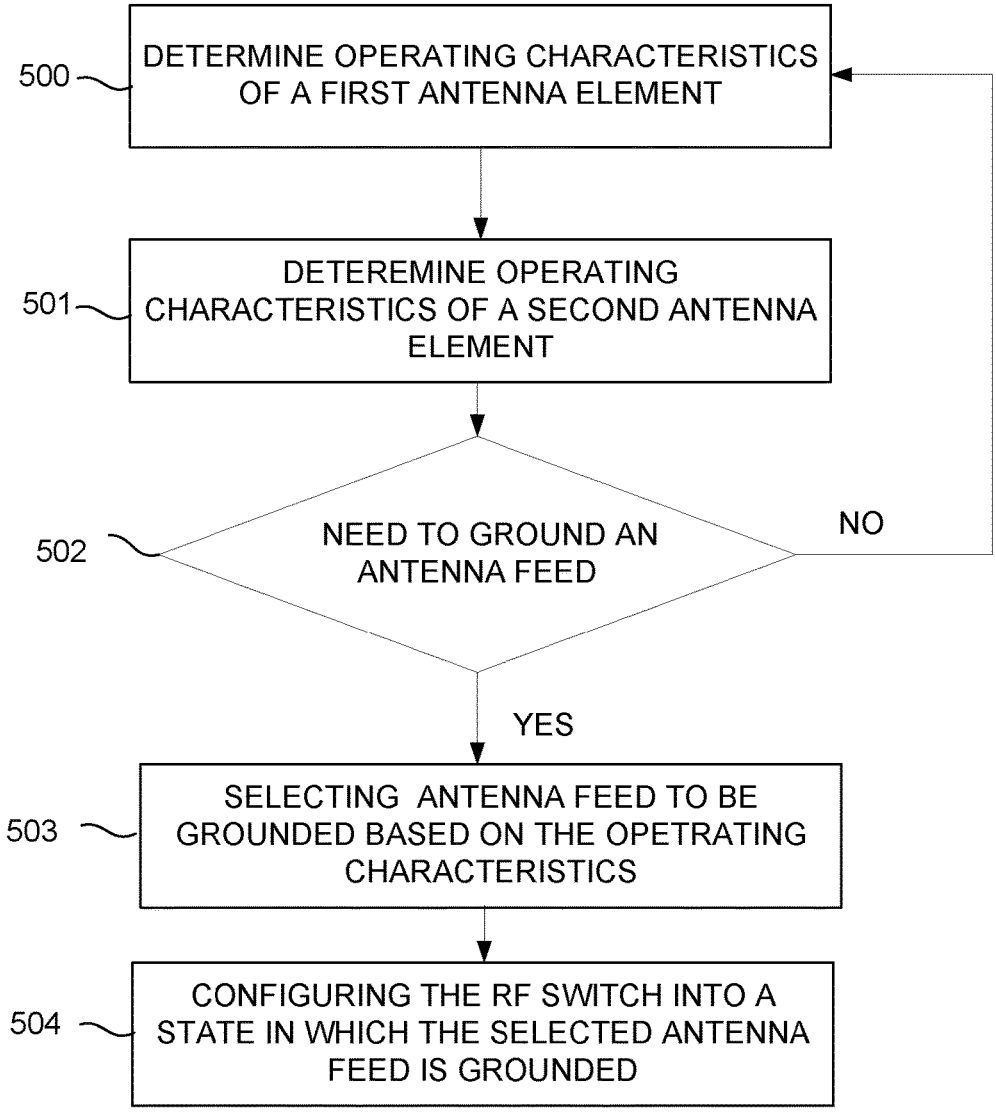
FIG. 6 illustrates a schematic flow chart of a method for operation of an RF switch according to an embodiment.

FIG. 6 illustrates a method of operating antennas in a device as a schematic flow chart according to an embodiment. Referring to FIG. 6, the method may comprise Operations 500, 501, 502, 503 and 504. According to an embodiment, the method of FIG. 6 may be compiled into the program code 406,408. According to an embodiment, the method of FIG. 6 may be carried out by a controller. According to an embodiment the controller may comprise a hardwired logic circuit. Operation 500 may comprise determining the operating characteristics of a first antenna element 110, the first antenna element 110 being coupled to a first antenna feed 111. The antenna feed 111 may be coupled to a corresponding radio via an impedance matching circuit 115 and a feedline 119.

Operation 501 may comprise determining the operating characteristics of a second antenna element 112, the second antenna element 112 being coupled to a second antenna feed 113. The antenna feed 113 may be coupled to a corresponding radio via an impedance matching circuit 118 and a feedline 120.

Operation 502 may include deciding whether there is a need to ground an antenna feed. This decision may be based on, for example, whether operation of all the antennas is essential, the SAR levels due to the two antennas are too high, mutual coupling between the antennas etc. Operation 503 may be performed if a need to ground an antenna is determined. Otherwise the method may start again at operation 500.

Operation 503 may include selecting one of the antenna feeds 111, 113 to be grounded based on the operating characteristics determined in operations 500 and 501.

Operation 504 may include configuring an RF switch 105 into a state which grounds the antenna feed 111, or 113. According to an embodiment, RF switch 105 may be coupled to antenna feeds 111, 113 and a device ground plane 109 and configurable into multiple states. In a first antenna feed 111 may be grounded, in a second state antenna feed 113 may be grounded and in a third state, the RF switch 105 may be in a no connection state. RF switch 105 may ground an antenna feed 111, 113 by connecting it to the device ground plane 109.

According to an embodiment, operating characteristics of an antenna element 110, 112 may include one or more of: power radiated and/or received by the antenna, coupling with other antennas, availability of the corresponding wireless networks, proximity of a user, and availability of an alternative antenna element, for example, in a different antenna stack of the device 100.

Any range or device value given herein may be extended or altered without losing the effect sought. Also any embodiment may be combined with another embodiment unless explicitly disallowed.

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

The embodiments illustrated and described herein as well as embodiments not specifically described herein but within the scope of aspects of the disclosure constitute exemplary means for switching radio frequency signals, exemplary means for electrically grounding antenna elements and antenna feeds, exemplary means for radiating radio signals, exemplary means for matching impedance of feed lines to impedance of antenna radiators. For example, the elements illustrated in FIG. 1 and FIG. 4 constitute exemplary means for switching radio frequency signals, exemplary means for electrically grounding antenna elements and antenna feeds, exemplary means for radiating radio signals, exemplary means for matching impedance of feed lines to impedance of antenna radiators, exemplary means for carrying RF signals.

According to an embodiment there is a device comprising: a first antenna element coupled to a first antenna feed, the first antenna feed being coupled to a first feed line via a first impedance matching circuit; a second antenna element coupled to a second antenna feed, the second antenna feed being coupled to a second feed line via a second impedance matching circuit; and a radio frequency (RF) switch configurable into states; wherein in a first state, the switch is configured to ground the first antenna feed; in a second state, the switch is configured to be in a non-connection state, wherein neither the first antenna feed nor the second antenna feed is grounded; and in a third state, the switch is configured to ground the second antenna feed.

Alternatively or in addition to the above, the RF switch is configured to be located after the first and the second impedance matching circuits. Alternatively or in addition to the above, further comprising a controller configured to control the switch. Alternatively or in addition to the above, the controller is configured to: determine operating information of the first antenna element and the second antenna element; based on the determined operation information, select a state for the RF switch; and configure the RF switch into the selected state. Alternatively or in addition to the above, the RF switch comprises a single pole three throw solid state switch. Alternatively or in addition to the above, the RF switch comprises a Micro-Electro-Mechanical Systems device. Alternatively or in addition to the above, further comprising: a housing, the housing comprising at least one conductive portion; wherein first antenna element comprises a conductive portion of the housing. Alternatively or in addition to the above, comprising a third impedance matching circuit and a diplexer, wherein: the third impedance matching circuit is configured parallel to the first impedance matching circuit and coupled with the first antenna feed; and the first and third impedance matching circuits are coupled to one or more feed lines via the diplexer. Alternatively or in addition to the above, the first antenna element is configured for operation in a frequency range corresponding to Long Term Evolution High Band or Long Term Evolution Medium Band. Alternatively or in addition to the above, the second antenna element is configured for operation in a frequency range suitable for Wireless Local Area Networks.

According to an embodiment there is a device comprising: a first antenna element having a first end and a second end; a first shorting element coupled to the first antenna element at a first end; a first antenna feed coupled to the first antenna at a second end; a second antenna feed coupled to the first antenna element at a point between a central point of the first antenna element and the first shorting element; a second antenna element having two ends; a second shorting element coupled to the second antenna element at a first end; a third antenna feed coupled to the second antenna element at a point between a central point of the second antenna element and the second shorting element; an RF switch, wherein: in a first state, the switch is configured to ground the first shorting element; in a second state, the switch is configured to ground the third antenna feed; and in a third state, the switch is configured to ground the second antenna feed and the second shorting element.

Alternatively or in addition to the above, further comprising a housing; the housing comprising at least one conductive portion; and wherein the first antenna element comprises a conductive portion of the housing. Alternatively or in addition to the above, further comprising: a first radio coupled to the first antenna feed via a first impedance matching circuit; a second radio coupled to the second antenna feed via a second impedance matching circuit; and a third radio coupled to the third antenna feed via a third impedance matching circuit. Alternatively or in addition to the above, the first radio is configured to operate in a frequency range corresponding to Long Term Evolution High Band; wherein the second radio is configured to operate in a frequency range corresponding to Long Term Evolution Medium Band; and wherein the third radio is configured to operate in a frequency range corresponding to WLAN. Alternatively or in addition to the above, when the switch is configured in the first state, the second radio is configured to operate in a frequency range higher than a frequency range corresponding to Long Term Evolution Medium Band. Alternatively or in addition to the above, the third radio is configured to operate in an Industrial, Scientific and Medical (ISM) frequency range. Alternatively or in addition to the above, further comprising a controller, wherein the controller is configured to: determine operating information of the first radio, the second radio and the third radio; based on the determined operation information, select a state for the RF switch; and configure the RF switch into the selected state. Alternatively or in addition to the above, the controller receives user proximity information.

According to an embodiment there is a method of operating antennas in a device, carried out by the device, comprising: determining operating characteristics of a first antenna element, wherein a first antenna feed is coupled to the first antenna element; determining operating characteristics of a second antenna element, wherein a second antenna feed is coupled to the second antenna element; determining whether an antenna feed needs to be grounded; selecting, based on the operating characteristics of the first and the second antenna elements, an antenna feed to be grounded; and configuring the RF switch into a state, in which state the selected antenna feed is grounded; wherein the RF switch is coupled to the first antenna feed, the second antenna feed and an electrical ground plane and configurable into multiple states wherein; in a first state the RF switch is configured to connect the first antenna feed to the electrical ground plane; in a second state the RF switch is configured to connect the second antenna feed to the electrical ground plane; and in a third state the RF switch is configured to be in a no connection state.

Alternatively or in addition to the above, operating characteristics of an antenna element include one or more of: power radiated and/or received by the antenna, coupling with other antennas, availability of the corresponding wireless network, proximity of a user, and availability of an alternative antenna element.

It will be understood that the benefits and advantages described above may relate to one embodiment or may relate to several embodiments. The embodiments are not limited to those that solve any or all of the stated problems or those that have any or all of the stated benefits and advantages. It will further be understood that reference to 'an' item refers to one or more of those items.

The steps of the methods described herein may be carried out in any suitable order, or simultaneously where appropriate. Additionally, individual blocks may be deleted from any of the methods without departing from the spirit and scope of the subject matter described herein. Aspects of any of the examples described above may be combined with aspects of any of the other examples described to form further examples without losing the effect sought.

The term 'comprising' is used herein to mean including the method, blocks or elements identified, but that such blocks or elements do not comprise an exclusive list and a method or apparatus may contain additional blocks or elements.

It will be understood that the above description is given by way of example only and that various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the spirit or scope of this specification.

The invention claimed is:

1. A device comprising:

a first antenna element coupled to a first antenna feed, the first antenna feed being coupled to a first feed line via a first impedance matching circuit;

a second antenna element coupled to a second antenna feed, the second antenna feed being coupled to a second feed line via a second impedance matching circuit; and a radio frequency (RF) switch configurable into states;

wherein in a first state, the switch is configured to ground the first antenna feed;

in a second state, the switch is configured to be in a non-connection state, wherein neither the first antenna feed nor the second antenna feed is grounded; and in a third state, the switch is configured to ground the second antenna feed.

2. The device of claim 1, wherein the RF switch is configured to be located after the first and the second impedance matching circuits.

3. The device of claim 1, further comprising a controller configured to control the switch.

4. The device according to claim 3, wherein the controller is configured to:

determine operating information of the first antenna element and the second antenna element;

based on the determined operation information, select one of the states for the RF switch; and configure the RF switch into the selected state.

5. The device of claim 1, wherein the RF switch comprises a single pole three throw solid state switch.

6. The device of claim 1, wherein the RF switch comprises a Micro-Electro-Mechanical Systems device.

7. The device of claim 1, further comprising: a housing, the housing comprising at least one conductive portion; wherein first antenna element comprises a conductive portion of the housing.

8. The device of claim 1, comprising a third impedance matching circuit and a diplexer, wherein:

the third impedance matching circuit is configured parallel to the first impedance matching circuit and coupled with the first antenna feed;

and the first and third impedance matching circuits are coupled to one or more feed lines via the diplexer.

9. The device of claim 8, wherein the first antenna element is configured for operation in a frequency range corresponding to Long Term Evolution High Band or Long Term Evolution Medium Band.

10. The device of claim 8, wherein the second antenna element is configured for operation in a frequency range suitable for Wireless Local Area Networks.

11. A device comprising:

a first antenna element having a first end and a second end;

a first shorting element coupled to the first antenna element at a first end;

a first antenna feed coupled to the first antenna at a second end;

a second antenna feed coupled to the first antenna element at a point between a central point of the first antenna element and the first shorting element;

a second antenna element having two ends;

a second shorting element coupled to the second antenna element at a first end;

a third antenna feed coupled to the second antenna element at a point between a central point of the second antenna element and the second shorting element;

an RF switch, wherein:

in a first state, the switch is configured to ground the first shorting element;

in a second state, the switch is configured to ground the third antenna feed; and in a third state, the switch is configured to ground the second antenna feed and the second shorting element.

12. The device of claim 11, further comprising a housing; the housing comprising at least one conductive portion; and wherein the first antenna element comprises a conductive portion of the housing.

13. The device of claim 11, further comprising:

a first radio coupled to the first antenna feed via a first impedance matching circuit;

a second radio coupled to the second antenna feed via a second impedance matching circuit; and a third radio coupled to the third antenna feed via a third impedance matching circuit.

14. The device of claim 13, wherein the first radio is configured to operate in a frequency range corresponding to Long Term Evolution High Band;

wherein the second radio is configured to operate in a frequency range corresponding to Long Term Evolution Medium Band; and wherein the third radio is configured to operate in a frequency range corresponding to WLAN.

15. The device of claim 13, wherein when the switch is configured in the first state, the second radio is configured to operate in a frequency range higher than a frequency range corresponding to Long Term Evolution Medium Band.

16. The device of claim 13, wherein the third radio is configured to operate in an Industrial, Scientific and Medical (ISM) frequency range.

17. The device of claim 13, further comprising a controller, wherein the controller is configured to:

determine operating information of the first radio, the second radio and the third radio;

based on the determined operation information, select one of the states for the RF switch; and configure the RF switch into the selected state.

18. The device of claim 17, wherein the controller receives user proximity information.

19. A method of operating antennas in a device, carried out by the device, comprising:

determining operating characteristics of a first antenna element, wherein a first antenna feed is coupled to the first antenna element;

determining operating characteristics of a second antenna element, wherein a second antenna feed is coupled to the second antenna element;

determining whether an antenna feed needs to be grounded;

selecting, based on the operating characteristics of the first and the second antenna elements, an antenna feed to be grounded; and configuring the RF switch into a state, in which state the selected antenna feed is grounded;

wherein the RF switch is coupled to the first antenna feed, the second antenna feed and an electrical ground plane and configurable into multiple states wherein;

in a first state the RF switch is configured to connect the first antenna feed to the electrical ground plane;

in a second state the RF switch is configured to connect the second antenna feed to the electrical ground plane; and in a third state the RF switch is configured to be in a no connection state.

20. The method according to claim 19, wherein operating characteristics of an antenna element include one or more of: power radiated and/or received by the antenna, coupling with other antennas, availability of the corresponding wireless network, proximity of a user, and availability of an alternative antenna element.

* * * * *